United States Patent [19]

Putnam

[11] Patent Number: 4,870,368

[45] Date of Patent: Sep. 26, 1989

[54] SPIRAL LINE ACCELERATOR

[75] Inventor: Sidney D. Putnam, Berkeley, Calif.

[73] Assignee: The Titan Corporation, San Diego, Calif.

[21] Appl. No.: 166,661

[22] Filed: Mar. 11, 1988

[51] Int. Cl.[4] ..... H05H 7/04

[52] U.S. Cl. ..... 328/233; 313/156

[58] Field of Search ..... 313/153, 156; 328/233

[56] References Cited

U.S. PATENT DOCUMENTS 4,780,682 10/1988 Politzer ..... 328/233

*Primary Examiner*—Kenneth Wieder

*Attorney, Agent, or Firm*—Ellsworth R. Roston; Charles H. Schwartz

[57] ABSTRACT

A casing has an entrance, an exit, linearly disposed, substantially parallel portions and curved portions joining the linear portions to define a spiral configuration. Electron pulses entering the casing are accelerated in the linear portions of the casings by pulsed electric fields applied across accelerating gaps in such linear portions. The gaps are aligned in common planes transverse to the linear portions and electrical power is applied by the same connector to the gaps to the gaps within each common transverse plane. Magnetic fields, constant in time over successive accelerating cycles, are created throughout the casing to confine electrons interior to the casing and to guide the electrons around the bends. A magnetic field perpendicular to the plane of each bend is created in the curved portions of the casing to guide the electrons around the bend, and its strength is adjusted to be appropriate for the average electron energy from previous accelerations. Another magnetic field parallel to the casing walls is applied over all portions of the spiral configuration where necessary to counteract the radially outward repulsive forces between the electrons of a high current pulse and to suppress growth of undesirable transverse motion of the electrons. A third magnetic field of the "alternating gradient, strong focussing" type is applied over curved and linear portions of the spiral configuration as necessary to further confine the transverse motion of the beam within the casing and to direct electrons with deviations in energy from the average energy of the pulse to move substantially parallel to the casing walls.

42 Claims, 6 Drawing Sheets

FIG. 1 PRIOR ART
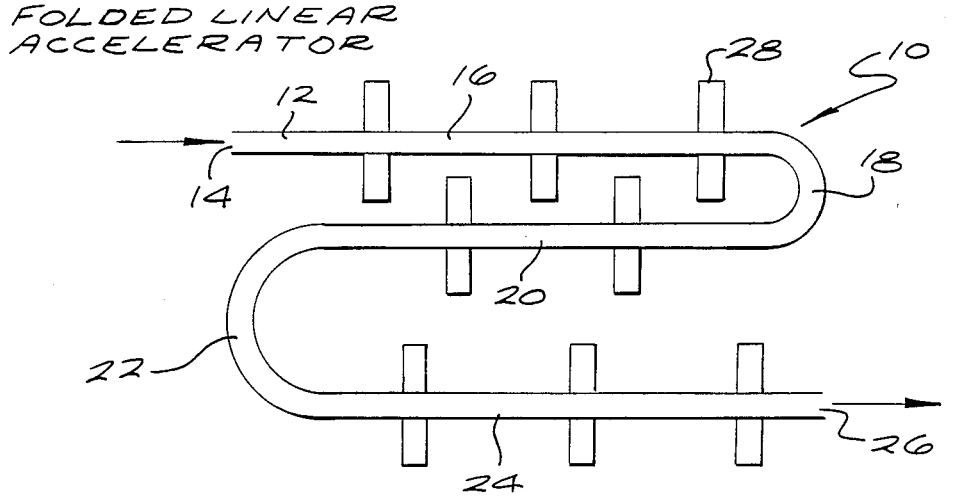
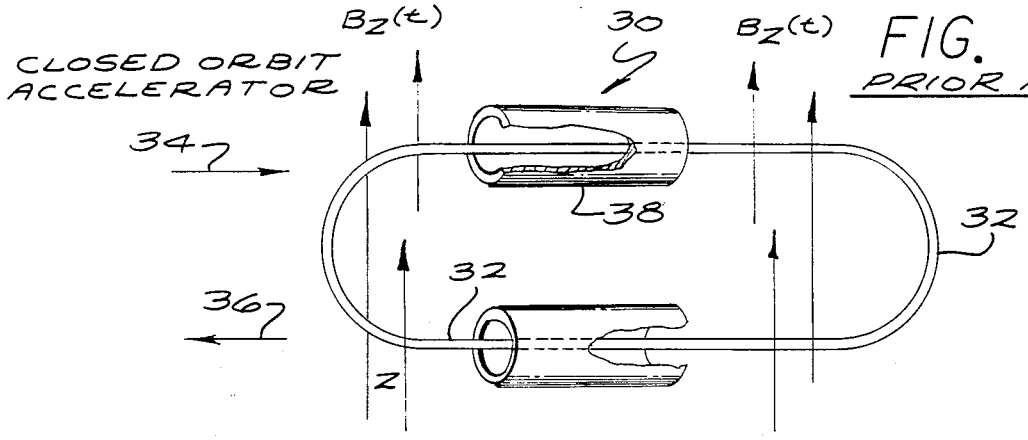
FIG. 2 PRIOR ART
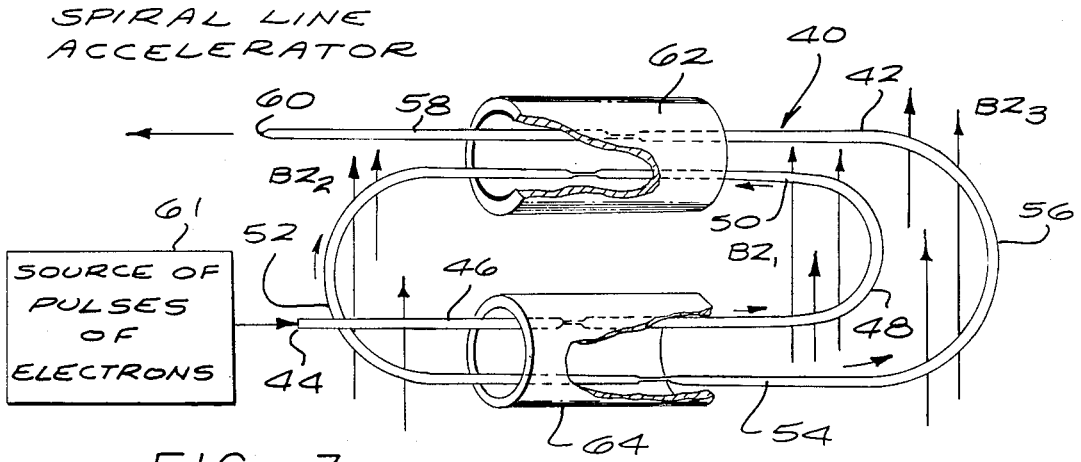
FIG. 3

FIG. 5
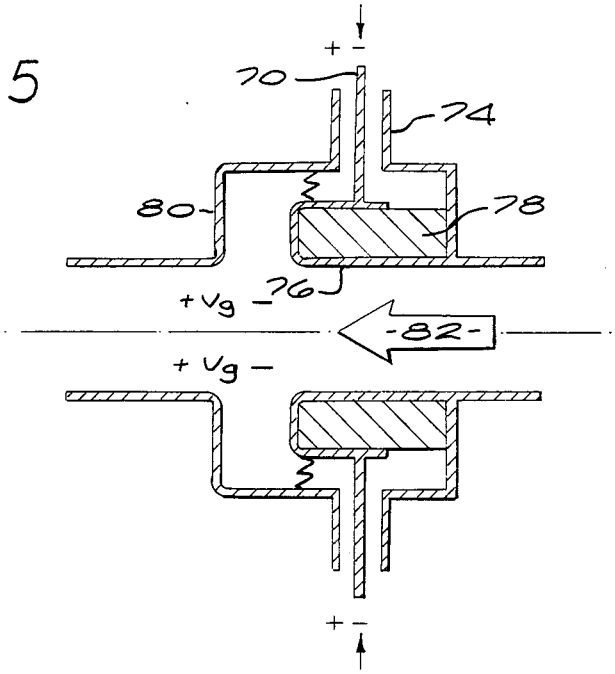
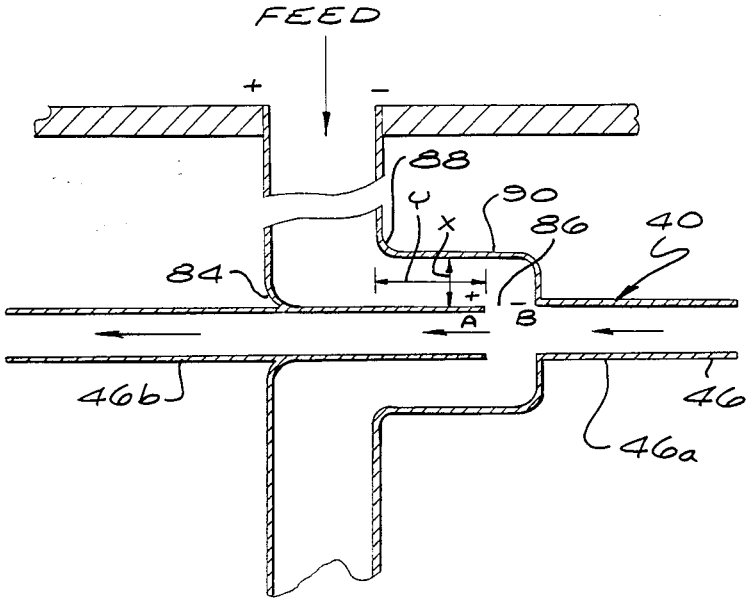
FIG. 6

SPIRAL LINE ACCELERATOR

This invention relates to apparatus for accelerating high currents of electrons. More particularly, this invention relates to apparatus which is compact and relatively light and inexpensive for accelerating electrons. The invention especially relates to apparatus for accelerating high current pulses of electrons in a compact space to impart considerable amounts of energy to such electrons.

Electrons at high energies and currents are provided for a multiple of purposes. For example, electrons at high energies and currents are used to bombard materials to produce copious quantities of electromagnetic radiation or to ionize such materials and determine the composition of such materials from the resultant charged particles and radiation. Electrons at high energies are also used to bombard materials so as to produce particles and energy matter other than electrons. Such particles and energy matter are then used in high level research for various purposes.

Different types of apparatus for accelerating electrons are now in use. For example, linear accelerators are in use. These accelerators are disposed in a linear relationship or are disposed in a folded linear relationship in which the accelerator is wound back and forth in a sinuous relationship such that one part of the accelerator does not cross another part of the accelerator. Such an accelerator is advantageous in that it can impart high energies to electrons passing through the accelerator. It is also advantageous in that the accelerator can operate upon pulses of electrons by applying a pulsed electrical field to the electrons. The accelerator is disadvantageous in that it is heavy and expensive.

Another type of accelerator is known as a closed orbit accelerator. Such an accelerator is generally disposed in a closed loop. This accelerator is advantageous in that it is light and compact and relatively inexpensive. Such an accelerator is disadvantageous in that it is not easy to introduce electrons of high current at low injection energies (few million electron volts) into the accelerator and to withdraw electrons from the accelerator because of the disposition of the accelerator in a closed loop.

A third type of accelerator is known as a spiral line accelerator. In a spiral line accelerator, portions of the accelerator are linear and other portions of the accelerator are curved. The curved portions are such as to dispose advanced portions of the accelerator in adjacent relationship to initial portions of the accelerator. In this way, the accelerator has the advantages of being compact and relatively lightweight and inexpensive. The accelerator also has the very important advantage of receiving electrons easily at the entrance to the accelerator and withdrawing electrons easily at the exit to the accelerator.

The spiral line accelerators of the prior art operate on electrons which are introduced to the accelerator on a continuous basis over the time for electrons to pass through the entire accelerator or longer. However, the acceleration of electrons on a continuous basis is not always considered desirable. For example, if electrons are produced on a continuous basis, the weight of the accelerating cell structure in the linear portion of the accelerator may be greatly increased compared to the weight of such cells if the accelerating electric fields are applied over the shorter time required by passing a short pulse of electrons through the accelerating region.

As will be appreciated, it has been known for some time that it would be advantageous to use a spiral line configuration to provide a compact geometry to accelerate electrons to high energy. Because of this appreciation, a considerable effort has been made, and significant amounts of money have been expended, to provide such an accelerator for continuous streams of electrons. In spite of such efforts and such expenditure of money, no one has been able to provide such an accelerator and furthermore, such an accelerator, if successfully developed, would be prohibitively heavy for many uses.

This invention provides a spiral line accelerator which operates to accelerate pulses of electrons and which has a different magnetic field configuration than the prior art in order to prevent electrons from impinging on the walls of the casing. The accelerator imparts substantial increases in energy to the electrons in the pulses during the movement of the electrons through the accelerator. The accelerator imparts such considerable increases of energy to the electrons while directing the movement of the electrons through the spiral path defined by the accelerator. The accelerator imparts such energy without losing any significant number of electrons because of impingement of the electrons on the walls of the accelerator.

In one embodiment of the invention, a casing has an entrance and an exit and linearly disposed portions substantially parallel to one another and curved portions joining the linear portions to provide the casing with a spiral configuration. A pulse of electrons (or a series of electron pulses appropriately spaced) admitted into the casing through the entrance is accelerated in the linear portions of the casings by electric fields applied across a series of accelerating gaps in each casing.

The gaps of each casing in the linear portions of the accelerator are aligned to be located in common planes transverse to the linear direction of electron motion.

The accelerating electric field across all gaps within each common transverse plane is applied by the same driving power connections. The electric fields across the gaps of the linear portion of the acelerator are applied in a direction appropriate to accelerate the electrons through the region of the gaps. When the electron pulse is in portions of the casing other than the gap region, the electric field is of a size and direction to facilitate reset of the power circuitry to prepare for the next accelerating pulse when electrons return to the same linear portion of the accelerator.

Magnetic fields, constant in time over one or many accelerating cycle(s), are created throughout the casing to confine electrons interior to the casing and to guide the electrons around the bends. A magnetic field perpendicular to the plane of each bend is created in the curved portions of the casing to guide the electrons around the bend, and its strength is adjusted to be appropriate for the average electron energy from previous accelerations. Another magnetic field created parallel to the walls of the casing is applied over all portions of the spiral configuration where necessary to counteract the radially outward repulsive forces between the electrons of a high current pulse and to suppress growth of undesirable transverse motion of the electrons. Finally, a third magnetic field component of the "alternating gradient, strong focussing" type is applied over curved and linear portions of the spiral configuration as necessary to further confine the transverse motion of the beam within the casing, to direct electrons with deviations in energy from the average energy of the pulse to move substantially parallel to the walls of the casing, and to make the guiding system insensitive to small deviations or errors in the bending magnetic field.

An electrically conducting pipe may be placed around each casing and associated magnetic field coils to isolate that portion magnetically from the nearby portions of the casing as necessary. Alternatively, for isolation over long time scales, additional coils with appropriate current distributions may be used instead of the conducting pipe.

In the drawings:

FIG. 1 is a schematic drawing of a folded linear accelerator included in the prior art;

FIG. 2 is a schematic drawing of a closed orbit accelerator included in the prior art;

FIG. 3 is a schematic drawing of a spiral line accelerator constituting one embodiment of the invention;

FIG. 5 is a schematic view of an accelerating cell apparatus included in the linear portion of a folded linear or closed orbit accelerator of FIGS. 1 and 3 for accelerating the pulses of electrons introduced to the accelerator;

FIG. 6 is a more detailed schematic view of the accelerating gap contours included in the spiral line accelerating cell of FIG. 4 to minimize the transverse deflection of electrons passing through the linear portion of accelerator;

Figure 8:
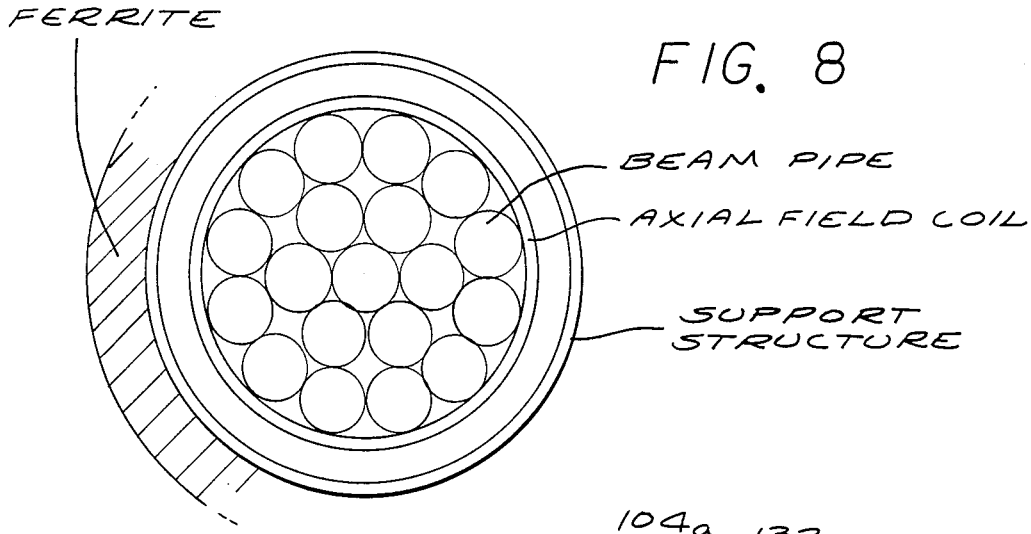
FIG. 8 is a schematic diagram illustrating in additional detail a "strong focussing" coil and associated magnetic field arrangement used in FIG. 7 for applying a magnetic field to the electrons during the movement of the electrons through one of the curved (or linear, as necessary) portions of the accelerator to prevent the electrons from impinging on the wall of such portions.
Figure 10:
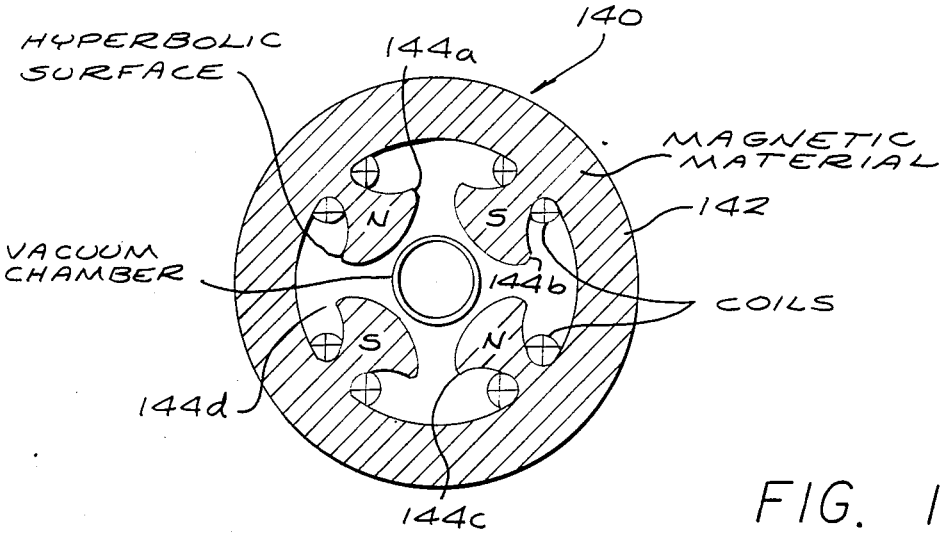
Figure 11:
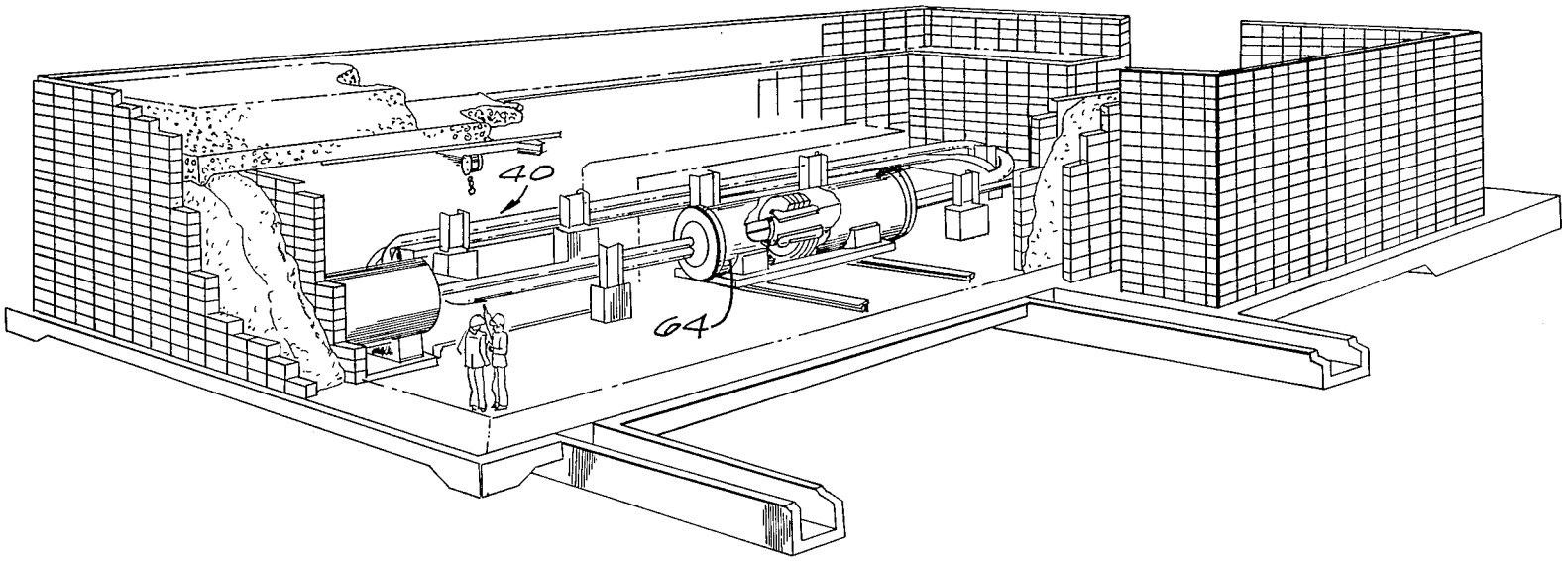

FIG. 10 is a sectional view of another embodiment of a magnetic focussing element of the invention for producing strong focussing magnetic field system which constitutes an alternate to the spiral coil system of FIG. 8 in the curved (and linear, as necessary) portions of the accelerator; and FIG. 11 is a schematic perspective view of the spiral line accelerator constituting one embodiment of the invention to indicate on a relative basis the size of this accelerator.

FIG. 1 illustrates a folded linear accelerator, generally indicated at 10, of the prior art. The accelerator 10 includes a casing 12 having an entrance 14, a linear portion 16, a curved portion 18, a linear portion 20, a curved portion 22, a linear portion 24 and an exit 26. As will be seen, the casing 12 has a sinuous configuration in which none of the portions is folded on itself. Accelerating cells 28, such as shown in FIG. 5, are associated with the linear portions of the casing 12 to accelerate electrons introduced into the casing through the entrance 14. The electrons may be introduced into the casing 10 in pulsed form and may be accelerated by the introduction of electrical fields in pulsed form to the accelerating cells 28.

The accelerator 10 may be considered to constitute a folded linear accelerator. It is advantageous in that electrons can be easily introduced into the casing 12 through the entrance 14 and easily removed from the casing through the exit 26. It is disadvantageous in that it is not compact in the vertical direction in FIG. 1 and in that each accelerating cell 28 can be used only once during each passage of the electrons through the casing. This causes the acelerator 10 to be relatively heavy and expensive.

FIG. 2 illustrates another accelerator, generally indicated at 30, of the prior art. The accelerator 30 includes a casing 32 disposed in a closed loop. Electrons are introduced into the casing 30 at a position, and in a direction, indicated by an arrow 34. Electrons are removed from the casing 32 at a position, and in a direction, indicated by an arrow 36. Accelerating cells 38, such as shown in FIG. 5, are associated with the linear portions of the casing 32 to accelerate the electrons introduced into the casing. The accelerating cells 38 may produce electrical fields in the same manner as the accelerating cells 28 in the folded linear embodiment shown in FIG. 1.

When pulses of electrons are introduced into the closed orbit accelerator 30 shown in FIG. 2, the electrons may be accelerated by the cells 38 as the electrons move past the cells. Actually, the electrons may be provided with a considerable acceleration by directing the electrons through several cycles of movement. Because of this, the accelerator 30 may be considered to be light and compact, particularly in relation to the amount of acceleration which can be imparted to the electrons.

One problem with the construction of the accelerator 30 for high currents of electrons injected at relatively low energies is in the gate for controlling the introduction of the elections into the casing 30 in a linear direction at first times and for providing at second times for a movement from the curved portion of the casing at the left in FIG. 2 to the upper linear portion in FIG. 2. A related problem with the construction of the accelerator 30 is the gate for controlling the transfer of the electrons from the casing in a linear direction at first times and for providing at second times for a curved movement of the electrons from the lower linear portion in FIG. 2 to the curved portion at the left in FIG. 2. As will be appreciated, these gates have to be quite precise in operation in order to obtain a proper operation of the closed orbit accelerator 30.

More importantly, injection of the high current electron pulse at relatively low energies (a few million electron volts or less), as is desired, necessitates application of a strong magnetic field component to prevent electrons from impinging on the casing due to their mutually repulsive space charge electric fields. This magnetic field component is generally parallel to the walls of the casing and is also disposed in a closed loop. The gate must therefore direct electrons across the magnetic field during injection and extraction, causing distortion of the beam shape and loss of electrons to the walls of the casing.

FIG. 3 illustrates a spiral line accelerator, generally indicated at 40, constituting one embodiment of this invention. The accelerator 40 includes a casing 42 having an entrance 44, a linear portion 46, a curved portion 48, a linear portion 50, a curved portion 52, a linear portion 54, a curved portion 56, a linear portion 58 and an exit 60. As will be seen in FIG. 3, the different portions of the casing 42 are wound back on themselves in both the horizontal and vertical directions in FIG. 3. This causes the linear portions 50 and 58 to be adjacent each other and the linear portions 46 and 54 to be adjacent each other. The linear portions 46, 50, 54 and 58 are preferably disposed in substantially parallel relationship.

Figure 4:
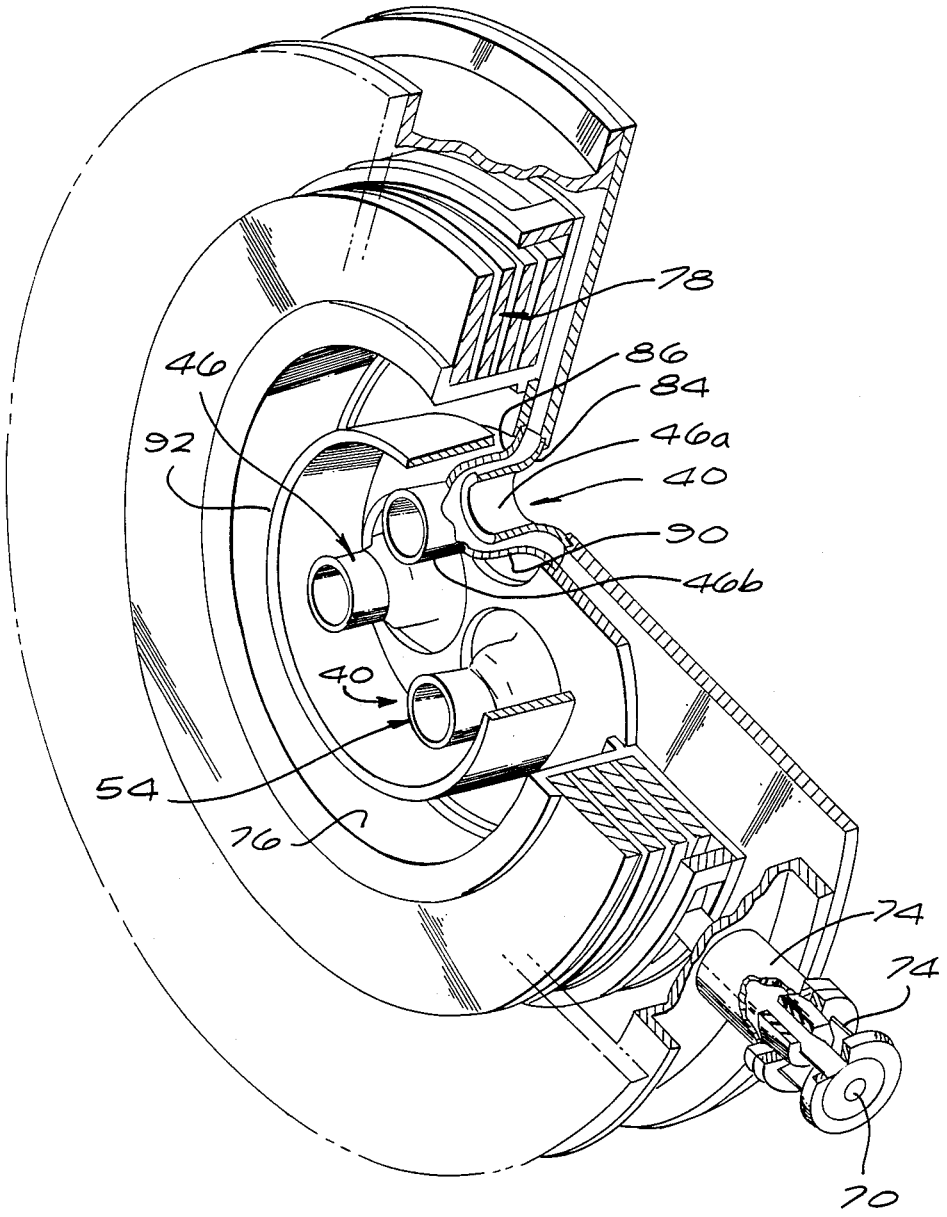
FIG. 4 is a fragmentary perspective view, partially broken away, showing certain features (for the example of three beam pipes) included in one of the accelerating cell structures of the linear portions of the spiral line accelerator of FIG. 3.

Pulses of electrons are introduced into the casing 42 from a source 61 through the entrance 44, are accelerated electrically during their movement through the casing and are collected after their passage through the exit 60. Because of the adjacent and parallel relationship of the linear portions 50 and 58, the accelerating gaps of each parallel casing can be aligned to be located in common planes transverse to the linear direction of electron motion. The accelerating electric field across all gaps within each common transverse plane is applied by the same power supply connection, as shown in FIG. 4. Similarly, because of the adjacent and parallel disposition of the linear portions 46 and 54, single accelerating cells in the region 64 (FIG. 3) can be provided to accelerate the electrons across all gaps of the casings in common transverse planes in these linear portions. By providing a series array of such single accelerating cells for the electrons in the linear portions 46 and 54 and a series array of such single accelerating cells for the electrons in the linear portions 50 and 58, the construction of the spiral line accelerator 40 can be significantly simplified and the weight and cost of the accelerating cells significantly reduced.

In the embodiment shown in FIG. 3, the electrons are directed in a curved path through the curved portions 48 and 56 by producing a magnetic field in a direction perpendicular to the plane of the paper in FIG. 3. This magnetic field and all other magnetic field components of the accelerator are constant in time over one or many acceleration cycles, resulting in very low errors in the magnetic fields inside each casing.

The strength of the bending magnetic field and the speed of movement of the electrons control the magnitude of the force imposed upon the electrons in FIG. 3. This force in turn controls the curvature in the movement of the electrons. As will be appreciated, this force can be controlled to match the curvature in the movement of the electrons with the curvature of each of the curved portions 48and 56. Similarly, a controlled magnetic field can be provided to move the electrons through the curved path 52.

As will be appreciated, the magnetic field applied to move the electrons through the curved portion 48 is preferably different in strength from the magnetic field applied to move the electrons through the curved portion 56. This results from the fact that the portion 48 may have a different curvature than the portion 56 and more importantly from the fact that the electrons in different bends have different energies from previous accelerations. Because of these considerations, the magnetic field applied to the electrons in the curved portion 48 preferably has a greater magnitude than the magnetic field applied to the electrons in the curved portion 56.

As will also be appreciated, since it is not possible to provide all electrons of the pulse precisely the same energy, the strength of the bending magnetic field in each curved portion is appropriately adjusted to guide electrons of the average energy of electrons of the pulse from previous accelerations. Furthermore, the magnetic field applied to the electrons in the curved portion 48 are preferably shielded magnetically from the magnetic field in the curved portion 56. By shielding the magnetic field applied to the electrons in the curved portion 48 from the magnetic field applied to the electrons in the curved portion 56, a precise control can be separately applied over the forces applied to the electrons in each of the curved portions 48 and 56 to obtain a desired movement of the electrons through each of the curved portions.

A voltage pulse is applied to a terminal 70 in FIG. 4 to create an electrical field for accelerating the electrons in each pulse. The terminal 70 is coaxial with a line 74 to receive a voltage in the order of several hundred kilovolts. The terminal 70 and the line 74 are electrically connected to the accelerating gaps of the three beam pipes in the example shown in FIG. 4. Each such voltage pulse imparts an additional energy in the order of severl hundred kilovolts to the electrons passing through the accelerating gap. Many such gaps and associated accelerating cells are spaced at small intervals along the linear portion of each casing. Such voltage pulses, applied synchronously across the array of gaps with the electron motion, result in electron energy gains of several to tens of millions of electron volts during the passage of the pulse through each casing of the linear portions of the accelerator.

One arrangement for applying the voltage pulses to create the electrical field is shown in FIG. 5 for a single accelerating gap of a single beam pipe such as would pertain to a folded linear or closed orbit accelerator. Such an accelerating cell is commonly called an induction cell and is particularly appropriate for accelerating high currents of electrons.

The adaptation of the induction cell principle to the spiral line geometry is shownin FIG. 4, as will be appreciated from close inspection. The arrangement includes a terminal 70 and a coaxial line 74. The line 70 communicates with a C-shaped annular member 76 in which is housed a ferrite or ferromagnetic material 78. The coaxial line 74 in turn communicates with an annual member 80 which is spaced from the member 76 to create an electrical field between the members 76 and 80 (the accelerating gap). As will be seen, this electrical field is in the direction opposite to the movement of the electron beam (the pulse of electrons). The direction of this electron beam is indicated by an arrow 82 in FIG. 5.

The ferrite 78 acts as an inductance in preventing a short circuit from being created across the gap between the terminal 70 and the coaxial line 74 during the passage of the pulse across the gap. When the electron pulse is outside the gap, the electric field in the gap is of a strength and direction to facilitate reset of the ferri (of ferro) magnetic material and power supply so that a subsequent accelerating field can be applied when the electron pulse returns to the gap in the common transverse plane in another casing.

By applying a voltage to accelerate the electron pulse and then reversing the voltage when the electron pulse is outside the gap to reset the magnetic material 78, the same magnetic material can be used over and over. This feature of the spiral line accelerator is rendered feasible by accelerating a pulse of electrons instead of a continuous stream. It significantly reduces the amount of heavy magnetic material which is required to prevent a short circuit from being created across the accelerating gap. As a result, it significantly reduces the weight of the accelerator.

FIG. 6 illustrates in more detail the shape of an embodiment of the accelerating gap for spiral line configuration. In the arrangement shown in FIG. 6, the voltage obtained from the members shown in FIG. 5 is introduced in the vertical direction designated as "Feed". The arrangement in FIG. 6 includes the casing 40 at one of the linear portions such as the portion 46. A gap 86 is provided in the linear portion 46 to define two (2) spaced linear portions 46*a* and 46*b*.

A flared portion 88 communicates with the linear portion 46*a* and a flared portion 84 communicates with the linear portion 46*b*. The flared portion 88 is shaped to define a portion 90 extending in a direction substantially parallel to the linear portions 46*a* and 46*b*. The portion 90 is spaced from the linear portion 46*b* to define a gap "X" in the vertical direction in FIG. 6 between the portion 90 and the linear portion 46*b*. This gap is sufficiently wide for the applied voltage so that stray electrons are not emitted from the casing 90 in the vertical direction in FIG. 6.

The portion A-B is provided with a length typically of a few centimeters. In this length, an electrical voltage of several hundred kilovolts is produced between the linear portions 46*a* and 46*b* of the casing 40.

The length of the casing portion 46 common to the portion 90 is illustrated at "Y" in FIG. 6. This length has a sufficient dimension to allow the current patterns from the electrical feed to become symmetrical about the axis of casing 46 in the portion 90. Such an arrangement reduces the transverse motion of the electron pulse in the gap region.

FIG. 4 includes in perspectiveform the arrangement shown in FIGS. 5 and 6 for accelerating the electrons in adjacent linear portions, such as the portions 46 and 54, of the casing 40. FIG. 4 also shows a coil 92 which is helically wound around the adjacent linear portions, such as the portions 46 and 54, to impart a magnetic field in the direction of movement of the electrons along the casing. This magnetic field is provided to prevent transverse expansion of the electron beam due to the self-generated repulsive electric fields of the beam and to suppress high frequency transverse motion of the electrons generated during the linear movement of the electrons through the accelerating gaps of the linear portions 46 and 54 of the casing 40. An alternate arrangement for providing such a magnetic field is to wind smaller coils around each individual beam pipe between each accelerating gap.

Figure 7:
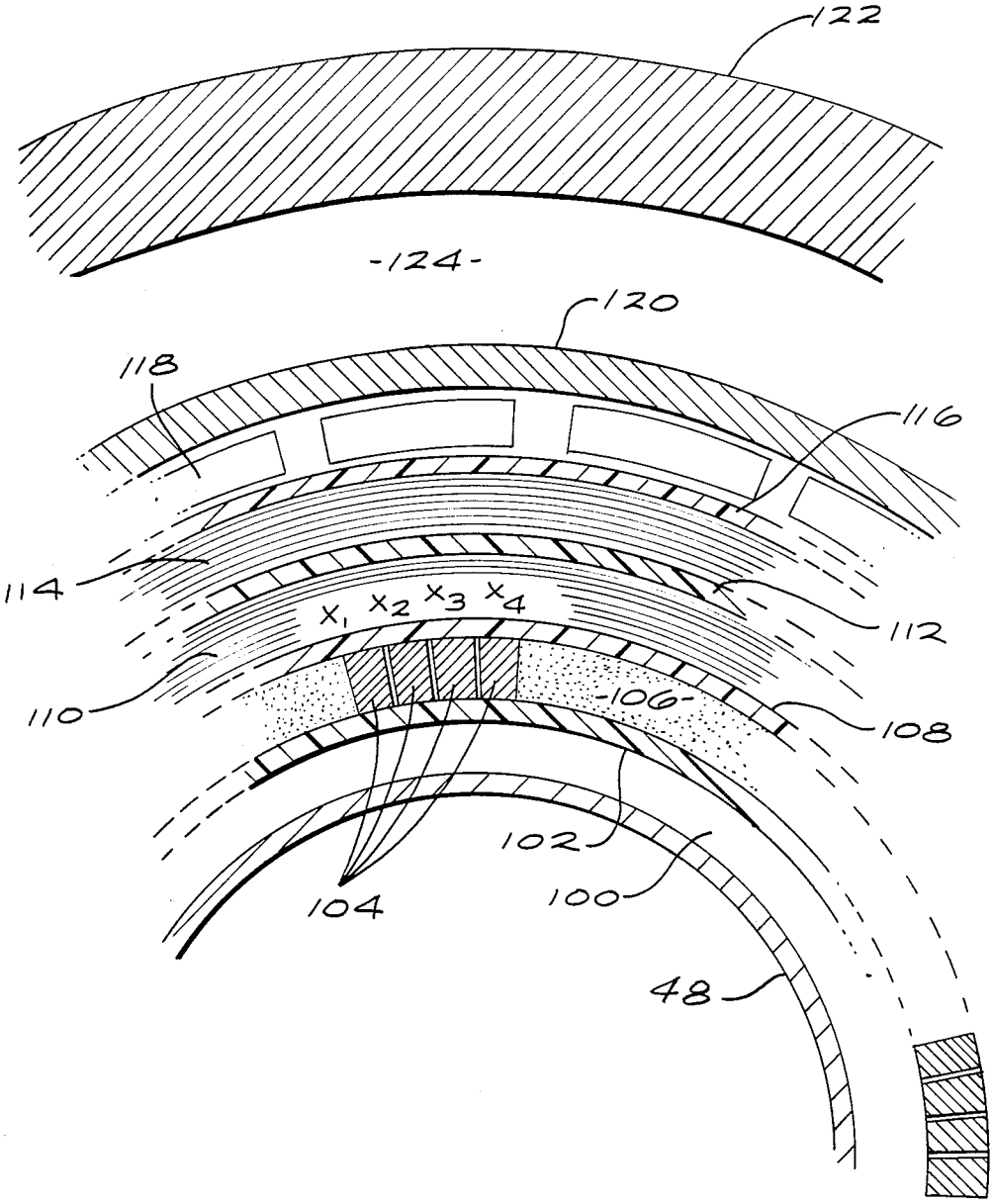
FIG. 7 is an enlarged fragmentary sectional view of an embodiment of magnetic field coil configurations included in the spiral line accelerator for applying magnetic fields to bend the paths of the pulses of electrons so that the electrons can move through the curved portions of the spiral line accelerator without impinging on the walls of the accelerator.

FIG. 7 is a sectional view illustrating apparatus for producing a controlled movement of the electrons in each pulse through one of the curved portions, such as the portion 48, of the accelerator 40. The apparatus shown in FIG. 7 illustrates the curved portion 48 of the casing 42 and further illustrates an electrically insulating spacer 100 disposed on the curved portion 48. An electrical insulator 102 is disposed on the spacer 100. A plurality of windings 104 are helically wound on the electrical insulator 102. Preferably four sets or groups of windings, each group as indicated at 104, are wound so that each of the four (4) sets of windings has a quadrant relationship and the quadrant relationship rotates with progressive positions along the casing 40. The windings 104 may be disposed in fixed position as by an epoxy 106.

An electrical insulator 108 is disposed on the windings 104 and a winding 110 is provided on the insulator 108. The solenoidal-type winding 110 is wound in continuous loops on the insulator 108 to produce a magnetic field in a direction corresponding to the direction of the curved portion 48 of the casing 40. In like manner, an electrical insulator 112 is disposed on the winding 110 and a solenoidal type winding 114 is disposed on the insulator 112 to further increase the strength of the magnetic field in the direction of the curved portion 48 of the casing 40, as necessary.

An electrical insulator 116 is disposed on the winding 114 and a winding 118 is provided on the insulator 116. The turns of the winding 118 extend in a direction perpendicular to the plane of the paper in FIG. 7 and the distribution of the coils varies in azimuth about the centerline of the casing in a manner commonly referred to as the "cosine theta" form. An electrical insulator 120 is provided on the winding 118. A magnetic shield 122 made from a suitable material such as aluminum is disposed in concentric relationship with the pipe 48, the insulators 102, 108, 112 and 120 and the windings 104, 110, 114 and 118. The magnetic shield 122 is preferably spaced from the insulator 120 as by an air zone 124. The spacing may be provided by a plurality of nonmagnetic stilts (not shown).

The windings 110 and 114 produce a magnetic field in the same direction as the direction of the curved portion 48 of the casing 40. This magnetic field in turn acts upon the electrons in each pulse to prevent the radial width of the pulse from increasing as the electrons move through the casing 40.

The winding 118 produces a magnetic field in a direction perpendicular to the plane of the paper in FIG. 3. This causes a force to be produced in a direction perpendicular to the magnetic field produced by the windings 110 and 114 and in a direction perpendicular to the direction of movement of the electrons in the casing 40. Because of this, this force acts upon the electrons to bend the movement of the electrons so that the electrons can pass through the curved portion 48 without impinging on the walls of the casing.

The sets of windings 104 produce magnetic fields in a direction for producing a generally corkscrew (or spiral) motion of the electrons as the electrons pass through the curved portion 48 of the casing 40. This magnetic field is illustrated in FIG. 8. As will be seen, the helical and interleaved disposition of the four sets (of four windings 104 in each set) are illustrated at 104*a*, 104*b*, 104*c* and 104*d*. This interleaved disposition causes magnetic fields to be produced on a quadrant relationship in the curved portion 48 of the casing 40. These magnetic fields are respectively illustrated by arrows at 132*a*, 132*b*, 132*c* and 132*d* in FIG. 8. The relative disposition of the magnetic fields 132*a*, 132*b*, 132*c* and 132*d* in a quadrant arrangement becomes progressively rotated with progressive positions along the curved portion 48 because of the progressive annular rotation of the windings 104*a*–104*d* with such progressive positions along the curved portion 48.

The magnetic field pattern generated by the windings 104*a*, 104*b*, 104*c*, and 104*d* in FIG. 8 is of a type commonly called an "alternating gradient, strong focussing" system and is provided to further confine the electrons with transverse components of motion interior to the casing. Also, this magnetic field pattern is included to increase the tolerance of the guiding system to deviations in electron energy from the average energy of the pulse and to small deviations or errors in the bending field.

The magnetic shield 122 in FIG. 7 acts as a magnetic barrier over one or several accelerating cycles against the passage of magnetic flux from the currents flowing through any of the windings 104*a*–104*d* or any of the windings 110, 114 and 118. This is important for insuring that the magnetic fields associated with the curved portion 48 cannot interfere with the magnetic fields associated with the curved portion 56 and vice versa. The magnetic shield 122 is particularly effective in confining the magnetic flux because of the spacing provided by the zone 124. The magnetic shield is effective to confine such magnetic fluxes because it produces eddy currents in response to any fluxes resulting from the currents in the windings 110, 114 and 118 and the windings 104*a*–104*d*. Such eddy currents create magnetic fields which oppose the magnetic fields created by the currents through the windings 110, 114 and 118 and the windings 104*a*–104*d*.

The electrically conducting magnetic shield 122 is preferable when short time periods for the pulses of electrons are involved. When lengthened time periods for the purposes of electrons are involved, the magnetic shield 122 may be replaced by coils disposed in generally the same position as the shield and with externally driven currents of generally the same distribution as the eddy currents in the conducting shield.

It will be appreciated that the arrangement shown in FIG. 7 is individual only to the curved portion 48 of the casing 40. Arrangements similar to that shown in FIG. 7 are preferably provided for each of the other curved portions in the casing 40 such as the portions 52 and 56. It will also be appreciated that the arrangement shown in FIGS. 4, 5 and 6 is intended to be used with adjacent linear portions such as the portions 46 and 54. An arrangement similar to that shown in FIGS. 4, 5 and 6 is provided for the linear portions 50 and 58. The spiral windings of FIG. 8 may also be extended outside the curved portions of the accelerator to further confine the transverse electron motion in the linear regions, as necessary.

FIG. 10 illustrates an alternate magnetic focussing element for producing magnetic field patterns which perform the same function of confining transverse motion of the electrons as the spiral coil windings illustrated at 104*a*–104*d* in FIG. 8. This alternate magnetic quadrupole lens typically includes magnetic material generally indicated at 140 and having a ring 142 of magnetic material and a plurality of poles 144*a*–144*d*. The poles 144*a*–144*d* are disposed in a quadrant relationship. Each pole is oppositely polarized from the adjacent poles. Such a magnetic quadrupole type focussing lens may be utilized with a similar lens rotated by 90° with respect to the lens shown in FIG. 10 and displaced an appropriate distance along the bending region. These two focussing lenses operate in conjunction to provide an alternate strong focussing system to that produced by the spiral windings of FIG. 8.

An array of such quadrupole lens pairs, interspersed with coils producing a field perpendicular to the plane of the bend, will both guide the electrons around the end and also confine transverse electron motion to small dimensions within the cavity. In common with the magnetic field pattern produced by the spiral coils of FIG. 10, this alternate arrangement also provides guidance around the curved portion of the accelerator for electrons with deviations in energy from the average energy of the electron pulse and for electrons with the average energy when small deviations or errors exist in the bending field.

Figure 9:
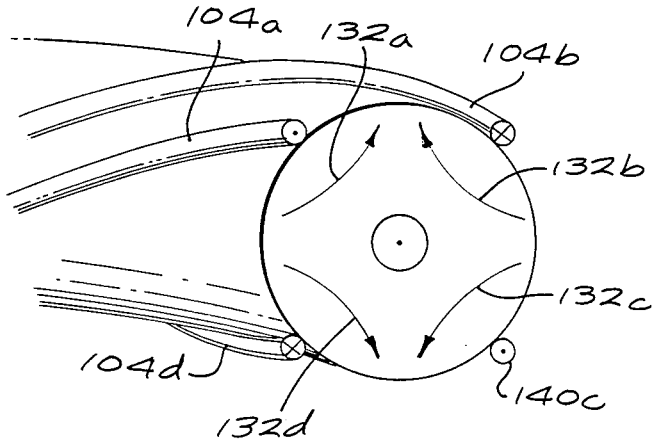
FIG. 9 is a cross section of an embodiment of the linear region of the accelerator and shows apparatus for producing an acceleration of the electrons in a number of adjacent linear portions in a spiral line accelerator such as shown in FIG. 3.

As will be appreciated, the provisions of a spiral line accelerator such as shown in FIG. 3 are only illustrative. Actually, the spiral line accelerator may be considerably more complex than that shown in FIG. 3. For example, the spiral line accelerator may have a considerably increased number of linear and curved portions than the number shown in the drawings. These linear portions may be disposed in juxtaposition as shown in FIG. 9.

The apparatus constituting this invention has certain important advantages. It provides a spiral line accelerator which is compact and relatively light and inexpensive. The accelerator especially provides a substantial acceleration to high current pulses of electrons in the accelerator. The accelerator provides this acceleration to the electrons without any significant loss in the electrons by impingement of the electrons on the walls of the accelerator, especially during entrance and exit of the electrons to and from the accelerator. The accelerator accomplishes this even with the movement of the electrons through a number of curved paths in the accelerator. Furthermore, this is accomplished even with the movement of the electrons through each of these curved paths at different energies and through different radii of curvature.

The apparatus described above also has other important advantages. It provides an accelerating cell arrangement, such as shown in FIGS. 4 and 6, which is operative on all of the gaps of adjacent linear portions in common transverse planes such as the portions 46 and 54 or the portions 50 and 58. This minimizes the weight, cost and complexity of the accelerator. Furthermore, the apparatus described above provides an acceleration of the electrons through the linear and curved portions such as the 48, 52 and 56 by producing magnetic fields as necessary in the direction of the movement of the electrons through the linear and curved portions to counteract the large mutually repulsive forces between the electrons. This feature is advantageous for high currents of electrons injected at desirable low energies. The apparatus also produces magnetic fields for preventing the electrons in the pulses from impinging on the walls of the casing in either the linear or curved portions of the casing.

Modifications and adjustments may be made in the apparatus constituting this invention without departing from the scope of the invention. Some examples are as follows:

1. For example, the spiral line configuration, with its independent beam lines for each recirculation, provides for easily changing the focussing magnetic field patterns in different portions of the accelerator to use magnetic patterns that may be more advantageous as the energy of the electrons increases. As magnetic field patterns such as the strong focussing pattern are changed within a recirculation from one recirculation to another, it will be appreciated that appropriate magnetic transition lenses are necessary to preserve the desired shape of the electron pulse.

2. Additional coil windings may be added around each casing as necessary in linear and curved portions to further increase the allowable deviations in electron energy from the average energy in the pulse. Such windings may be what are commonly called magnetic sextupole or octupole windings and may be applied in a continuous spiral fashion or as discrete lens elements. These windings are also advantageous in suppressing transverse motion of the beam generated by high frequency interactions of the beam with electromagnetic fields in the accelerating gaps.

3. Other accelerating cell arrangements which do not contain ferri (or ferro) magnetic materials may be used to provide appropriately spaced-in-time voltage pulses across the accelerating gaps and to prevent a short circuit from occurring during the time of passage of the electron beam through the gap.

4. It may be advantageous for high current beam acceleration to include elements such as damping materials, absorbers and/or appropriately designed holes or slots in the casings to suppress certain electromagnetic fields which interact especially with the high current electron beam and cause its impingement upon the walls of the casing.

5. In order to achieve still higher electron energies without increasing the energy gain of the electron pulse in the linear portions of the accelerator or without increasing the number of recirculations of the electrons and the number of casings of the accelerator, two or more spiral units may be arranged in a series fashion. The electron pulse extracted from the first unit may then be injected into the second unit and so forth. Alternatively, two or more spiral line units may be aligned substantially parallel, with the casings threaded through the linear portions of both units in an alternating fashion. This arrangement approximately halves (for the case of two units) the lengths of the linear portions of each unit while maintaining the same frequency of application of accelerating voltage pulses.

6. When a large number of recirculations are used in the spiral line accelerator or a series of spiral line units are used to accelerate to higher energies, it may be desirable to provide means to insure accurate preservation of the longitudinal extent and current shape in the time of the electron pulse. To do so, the transmit time of each electron in the pulse around the accelerator must be nearly the same, or isochronous. As will be appreciated, electrons of higher energy tend to move around the curved portions of the accelerator at larger radii and therefore take longer to transit the bend. In order to compensate for this effect the voltage pulse across the accelerating gaps may be adjusted to decrease slightly in the later portions of the accelerating pulse so as to accelerate the higher energy electrons which arrive later in the gap less than the lower energy electrons of the pulse which arrive earlier. Alternatively or additionally, magnetic guiding and bending elements may be introduced in portions of the accelerator to provide longer paths for lower energy electrons of the pulse in compensation for the longer paths of high energy electrons in traversing the bends.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for accelerating electrons, a spirally disposed hollow casing defined by spaced walls, the spiral casing having openings at opposite ends of the casing and having curved portions provided for a curved movement of the electrons and linear portions providing for a linear movement of the electrons, means for providing for an entrance of the electrons in pulses into the casing at one of the opposite ends of the casing, means for providing for an exit of the electrons in pulses from the casing at the other end of the casing, means for providing for accelerations of the electrons in the pulses during the travel of the electons through the linear portions of the casing, each of the accelerating means being disposed relative to the linear portions of the casing to provide for an acceleration of the electrons through more than one (1) of the linear portions of the casing, and means for guiding the movement of the electrons in the pulses through the linear and curved portions of the casing without striking the walls of the casing.

2. In a combination as set forth in claim 1, the means for providing for the accelerations of the electrons through the linear portions including means for creating a pulsed electrical field, and the means for providing for the movement of the electrons through the curved portions including means for creating a magnetic field in a direction perpendicular to the direction of movement of the electrons and perpendicular to the plane of the bend of the curved portions to produce the movement of the electrons through the curved portions.

3. In a combination as set forth in claim 1, means for providing a generally spiral movement of the electrons during the movement of such electrons through the curved portions of the casing to inhibit the movement of the electrons to the walls of the curved portions.

4. In a combination as set forth in claim 1, means for preventing high currents of electrons from moving toward the walls of the casing because of the action of their strong self-generated, mutually repulsive electric fields.

5. In a combination as set forth in claim 1, the spiral line casing having linear portions disposed in adjacent relationship to one another and having curved portions connecting the linear portions, each of the accelerating means for the electrons in the linear portions enveloping more than one (1) of the adjacent linear portions to accelerate the electrons moving through such linear portions and the guiding means for the electrons in each of the curved portions being individual to such curved portions.

6. In combination for accelerating electrons, a spirally disposed hollow casing having an entrance and an exit, the hollow casing being bent upon itself to define an undulating pattern having curved end portions and linear portions between the curved end portions, means for introducing electrons into the hollow casing through the entrance in the casing, means for passing electrons from the hollow casing through the exit in the casing, means for producing pulsed accelerations of the electrons in the linear portions of the casing, each of the accelerating means providing for an acceleration of the electrons in more than one (1) of the linear portions of the casing, first magnetic means operative in the casing for bending the path of the electrons to obtain a travel of the electrons through the curved portions, second magnetic means operative in the linear and curved portions of the casing to counteract repulsive forces between the electrons travelling in the casing, and third magnetic means operative upon the electrons to move the electrons through a spiral path during the movement of the electrons through the curved portions of the casing to inhibit the electrons from impinging upon the walls of the casing during such movement and to allow electrons with energy deviations from an average energy to be confined within the casing and electrons of the average energy to be confined when small deviations or errors exist in the bending magnetic field.

7. In a combination as set forth in claim 6, the electron-accelerating means including means for applying an electrical field to the electrons in the linear portions of the casing to accelerate the electrons in such linear portions of the casing, and means included in the field-applying means for preventing a short circuit from being created in the casing during the acceleration of the electrons in the linear portions of the casing.

8. In a combination as set forth in claim 7, the casing having an axis defining the direction of movement of the electrons in the casing, means for trapping electrons moving with relatively low velocities in a direction substantially perpendicular to the axis of the casing and for aligning, with the axis of the casing, electrons moving through the casing in a direction transverse to the axis of the casing.

9. In a combination as set forth in claim 8, the casing having a closed periphery in a plane substantially perpendicular to the axial direction, the second magnetic means creating a plurality of magnetic fields at spaced positions around the periphery of the casing and angularly adjusting the periphery positions of the magnetic fields with progressive positions in the casing in the axial direction to obtain the movement of the electrons in the generally spiral path during the movement of the electrons through the curved end portions.

10. In a combination as set forth in claim 6, means for guiding the electrons during the movement of the electrons through the curved portions of the casing.

11. In a combination as set forth in claim 9, means for guiding the electrons during the movement of the electrons through the curved portion of the casing, and fourth magnetic means for shielding the first, second and third magnetic fields for each of the curved portions of the casing from the magnetic fields produced for each of the other curved portions of the casing.

12. In combination for accelerating electrons, a casing having an entrance and an exit and disposed in a spiral path in which different portions of the casing are provided with a linear disposition and are disposed in adjacent relationship in a direction substantially perpendicular to the linear direction and are disposed in a substantially parallel relationship in the linear direction and in which the casing is disposed in curved paths at the ends of the linear portions to define portions coupling the linear portions, means for providing for an introduction of the electrons in pulses into the casing at the entrance to the casing, a plurality of means each enveloping adjacent linear portions of the casing to accelerate the electrons in the pulses during their travel through such linear portions, means for directing the electrons in the pulses through the casing in the curved paths at the ends of, and in, the linear portions without having the electrons impinge on the walls in the portions, and means for providing for a transfer of the electrons in the pulses from the casing at the exit from the casing.

13. In a combination as set forth in claim 12, the accelerating means including means for creating a pulsed electrical field in the linear direction, in the linear portions associated with such accelerating means, at the time of the movement of the electrons through such linear portions past the accelerating means and further including means for providing for a conversion into the linear direction in such linear portions of electrons moving transversely to the linear direction.

14. In a combination as set forth in claim 12, the means for directing the electrons in the curved path including means for producing a magnetic field in a direction substantially perpendicular to the plane defined by the curved path and for adjusting the strength of the magnetic field at successive positions in accordance with the curved path to be transversed by the electrons.

15. In a combination as set forth in claim 14, the magnetic means including means for producing a movement of the electrons in a generally spiral path spaced from the walls defining the curved portion of the casing, the accelerating means including means for creating a pulsed electrical field in the linear direction in the linear portions associated with such accelerating means and further including means for providing for a conversion into the linear direction in such linear portions of electrons moving transversely to the linear direction in such linear portions.

16. In a combination as set forth in claim 15, means for shielding the magnetic fields produced for each of the curved portions of the casing from the magnetic fields produced for the other curved portions of the casing.

17. In combination for accelerating electrons, a spirally disposed hollow casing defined by spaced walls, the spiral casing having portions providing for curved movements of the electrons and portions providing for linear movements of the electrons, means for providing an introduction of the electrons in pulses in to the casing, means associated with at least pairs of the linear portions of the casing for accelerating the electrons in such linear portions, first means for producing a magnetic field in a direction perpendicular to the movement of the electrons in the pulses, the magnetic field producing a force on the electrons in a direction perpendicular to the direction of the movement of the electrons in the pulses and the magnetic field thereby to produce a movement of the electrons through the curved portions of the casing, and second means for acting on the electrons in the pulses to produce a generally spiral movement of the electrons through the curved portions, thereby inhibiting the electrons from impinging on the walls of the casing.

18. In a combination as set forth in claim 17, the second means including means for producing different magnetic fields in individual quadrants of the curved portions of the casing and for rotating the positions of such different magnetic fields in such individual quadrants with progressive displacements along the curved portions of the casing.

19. In a combination as set forth in claim 18, means enveloping the first and second means for isolating the first and second means magnetically.

20. In a combination as set forth in claim 19, means disposed relative to the linear portions of the casing for directing the electrons in a direction corresponding to the linear direction of such linear portions.

21. In combination for accelerating electrons, a casing having an entrance and an exit and having linearly disposed portions substantially parallel to one another and having curved portions joining the linear portions to provide the casing with a spiral configuration, means for introducing the electrons in pulses into the casing through the entrance of the casing, means for providing for an acceleration of the electrons in the pulses in the linear portions of the casing, each of such acceleration means being operative upon the electrons in at least a pair of the linear portions in the casing, means for providing a bending movement of the electrons in the pulses through the curved portions of the casing, and means for operating upon the electrons in the pulses during the movement of the electrons in the pulses through the curved portions of the casing to inhibit any impinging of the electrons in the pulses on the walls of the casing during the movement of the electrons in the pulses through the curved portions of the casing.

22. In a combination as set forth in claim 21, means disposed in the linear portions of the casing for directing electrons to move in a direction corresponding to the direction of the linear portions of the casing when such electrons are moving at relatively low speeds in the pulses in directions transverse to the linear portions of the casing.

23. In a combination as set forth in claim 22, different ones of the accelerating means, the inhibiting means and the bending means being provided for individual ones of the curved portions of the casing, and means for isolating the accelerating means, the inhibiting means and the bending means for each of the curved portions from the accelerating means, the inhibiting means and the bending means for the other curved portions.

24. In a combination as set forth in claim 23, the means for inhibiting the impinging of the electrons including means for producing continuously rotating or discrete quadrupole type magnetic fields, the means producing the quadrupole type magnetic fields including a plurality of windings spirally wound relative to one another.

25. In a combination as set forth in claim 23, different ones of the linear portions being disposed in adjacent relationship, the accelerating means enveloping adjacent ones of the linear portions of the casing for creating an electrical field in such linear portions to accelerate the electrons in the pulses through such linear portions.

26. In combination for accelerating electrons, a casing having an entrance and an exit and having linearly disposed portions substantially parallel to one another and having curved portions joining the linear portions to provide the casing with a spiral configuration, means for providing for the introduction of pulses of electrons into the entrance of the casing, means for applying electrical fields in pulses to the pulses of electrons in the linear portions of the casing to accelerate the pulses of electrons through such linear portions, each of the accelerating means being operative to accelerate the electrons in more than one of the linear portions of the casing, means for applying magnetic fields to the pulses of electrons to bend the movement of the electrons to move through the curved portions of the casing.

27. In a combination as set forth in claim 26, different ones of the linear portions of the casing bein disposed in adjacent relationship, the accelerating means enveloping adjacent ones of such linear portions to accelerate the pulses of the electrons moving through such linear portions, and means for applying an additional magnetic field to the pulses of electrons during the movement of the electrons through the curved portions of the casing to inhibit the electrons from impinging on the wall of the casing.

28. In a combination as set forth in claim 26, the additional magnetic field having a quadrant relationship and producing a rotation of the quadrant relationship with progressive positions along the curved portion of the casing.

29. In a combination as set forth in claim 28, the additional magnetic means constituting a plurality of interleaved windings spirally wound around the casing.

30. In a combination as set forth in claim 27, different ones of the magnetic fields and the additional magnetic fields being provided for the individual ones of the curved portions of the casing.

31. In a combination as set forth in claim 30, a further magnetic field enveloping the magnetic field and the additional magnetic field for each curved portion of the casing to isolate each curved portion of the casing magnetically from the other curved portions of the casing.

32. In combination for accelerating electrons, a casing having an entrance and an exit and having a plurality of linearly disposed portions substantially parallel to one another and having curved portions joining the linear portions to provide the casing with a spiral configuration, different linear portions in the plurality being disposed in adjacent relationship, means for introducing pulses of electrons into the entrance to the casing, means disposed relative to adjacent linear portions of the casing to apply a common electrical field to the adjacent linear portions to accelerate the pulses of electrons moving through such linear portions, and means disposed relative to each of the curved portions of the casing for applying a magnetic field to such curved portion of the casing in a direction to produce a force on the electrons for moving the electrons through such curved portion of the casing.

33. In a combination as set forth in claim 32, means for magnetically isolating the magnetic field for each curved portion of the casing from the magnetic field for the other curved portions of the casing.

34. In a combination as set forth in claim 32, means for creating an additional magnetic field in each individual one of the curved portions of the casing in a direction to inhibit any impinging of the electrons on the wall of such curved portion of the casing during the movement of the electrons through such curved portion of the casing.

35. In a combination as set forth in claim 34, means for magnetically isolating the magnetic field and the additional magnetic field for each curved portion of the casing from the magnetic field and the additional magnetic field for the other curved portions of the casing, and means for acting upon the electrons in each pulse in the linear portions of the casing to redirect electrons transverse to such linear portions into a direction substantially parallel to such linear portions.

36. In a combination as set forth in claim 35, means for magnetically guiding the electrons in each pulse through the curved portions of the casing.

37. A method of accelerating electrons including the steps of:

providing a casing having an entrance and an exit and having a plurality of linearly disposed portions substantially parallel to one another and having curved portions joining the linear portions to provide the casing with a spiral configuration, linear portions in the plurality being disposed in adjacent relationship, introducing pulses of electrons into the entrance of the casing, applying a common electrical field in pulsed form to adjacent linear portions of the casing to produce an acceleration of the electrons in the pulses through such linear portions, applying a magnetic field to the pulses of electrons in the curved portions of the casing in a direction to produce a movement of the electrons through the curved portions of the casing, and receiving the pulses of electrons passing through the exit of the casing.

38. A method as set forth in claim 37 wherein the common electrical field is applied to the adjacent linear portions in the plurality in timed synchronization with the movement of the electrons through such adjacent linear portions.

39. A method as set forth in claim 38 wherein a different magnetic field is applied to each individual one of the curved portions of the easing and wherein the individual magnetic field in each of such curved portions of the casing is shielded magntically from the magnetic fields in the other curved portions of the casing.

40. A method as set forth in claim 37 wherein an additional magnetic field is applied to each curved portion of the casing in a direction to apply a generally spiral movement of the electrons through such curved portion of the casing to inhibit any impingement of the electrons in the pulses on the walls of such curved portion of the casing during such movement of the electrons through such curved portion of the casing.

41. A method as set forth in claim 39 wherein an additional magnetic field is applied to each curved portion of the casing in a direction to apply a generally spiral movement of the electrons through such curved portion of the casing to inhibit any impingement of the electrons on the wall of such curved portion of the casing during such movement of the electrons through such curved portion of the casing and wherein the electrical fields are applied to the pulses of electrons in the linear portions of the casing to direct the electrons in the pulses through the linear portions of the casing in a direction parallel to such linear portions.

42. A method as set forth in claim 41 wherein a magnetic field is applied to each curved portion of the casing to isolate such curved portion magnetically from the other curved portions of the casing.

* * * * *